US006655925B1

(12) United States Patent
Robenalt et al.

(10) Patent No.: US 6,655,925 B1
(45) Date of Patent: Dec. 2, 2003

(54) AIR COMPRESSOR MANIFOLD ASSEMBLY

(75) Inventors: David W. Robenalt, Jackson, TN (US); Dave C. Smith, Jackson, TN (US); Mark W. Wood, Jackson, TN (US); Robert F. Burkholder, Jackson, TN (US); Crandall B. Barbour, Jackson, TN (US); Mike L. Davis, Jackson, TN (US); Fred M. Morgan, Jackson, TN (US)

(73) Assignee: DeVilbiss Air Power Company, Jackson, TN (US)

( * ) Notice: Subject to any disclaimer, the term of this patent is extended or adjusted under 35 U.S.C. 154(b) by 0 days.

(21) Appl. No.: 09/802,149

(22) Filed: Mar. 8, 2001

Related U.S. Application Data

(60) Provisional application No. 60/187,744, filed on Mar. 8, 2000.

(51) Int. Cl.[7] ..... F04B 53/00

(52) U.S. Cl. ..... 417/234; 417/63; 137/557

(58) Field of Search ..... 417/63, 234; 137/565.1 A, 137/557

(56) References Cited

U.S. PATENT DOCUMENTS 2,116,642 A * 5/1938 Richter ..... 222/3
3,538,950 A * 11/1970 Porteners ..... 137/608
3,633,618 A * 1/1972 Blackmore ..... 137/557
3,760,842 A * 9/1973 Mikiya ..... 137/557
4,027,993 A * 6/1977 Wolff ..... 415/1
4,622,857 A * 11/1986 Nelson ..... 137/557
4,688,308 A * 8/1987 Alvarez ..... 29/33
5,303,733 A * 4/1994 Nelson ..... 137/505.38
5,598,869 A * 2/1997 Nelson ..... 137/505.11
6,202,684 B1 * 3/2001 Angel et al. ..... 137/557
6,447,257 B2 * 9/2002 Orschell ..... 417/201

OTHER PUBLICATIONS

TII Technical Education Systems, 1996, Explorer I Industrial Pneumatics, 4 pages.*
MACK™, 2002, Fire & Rescue Portable Systems, 2 pages.*
Northern Tool & Equipment Co.,2001, NorthernTool.com, Northstar Regulator/Manifold Kit, 2 pages.*
Hydraulic Hose Fittings, 2002, airhosereels.com push to connect fitings, 2 pages.*

* cited by examiner

*Primary Examiner*—Charles G. Freay
*Assistant Examiner*—John F Belena
(74) *Attorney, Agent, or Firm*—Suiter West PC LLO

(57) ABSTRACT

A manifold assembly is provided for controlling and distributing compressed air from an air compressor to one or more air powered tools. The manifold assembly may be attached directly to the air compressor, or, alternately, removed from the air compressor and coupled thereto via an air conduit, e.g., an air hose or the like, so that the manifold assembly can be used at locations remote from the air compressor.

58 Claims, 10 Drawing Sheets

AIR COMPRESSOR MANIFOLD ASSEMBLY

CROSS-REFERENCE TO RELATED APPLICATIONS

The present application claims the benefit under 35 U.S.C. § 119(e) of U.S. Provisional Application Ser. No. 60/187,744, filed Mar. 8, 2000. Said U.S. Provisional Application Ser. No. 60/187,744 is herein incorporated by reference in its entirety.

FIELD OF THE INVENTION

The present invention generally relates to the field of air compressors, and more particularly to an air compressor having a removable manifold assembly capable of being remotely located from the air compressor for controlling and distributing compressed air from the air compressor to one or more air powered tools.

BACKGROUND OF THE INVENTION

Air compressors are used to provide compressed air for operating air powered tools such as nailing tools, socket driving tools, material shaping tools, sanding tools, spray painting tools, inflation chucks, and the like. Frequently, it is desirable to operate several tools from air supplied by a single air compressor. In such instances, the air outlet port or "pressure manifold" of the air compressor is fitted with an adapter allowing the attachment and removal of multiple air hoses for providing air to operate several air powered tools at once. However, in many applications, the air compressor must be located remotely from the workers utilizing the tools for which it provides air. For instance, at a typical construction site, a single air compressor may be required to provide air to operate a plurality of tools, which, because of the physical layout of the site, are used at locations where the air compressor cannot be transported. For example, workers may be working in an upper story of an unfinished building while the air compressor is located on the first story. Similarly, wherein the air compressor is driven by an electric motor, it may be desirable to situate the air compressor near a source of electrical power such as an electrical outlet, an electrical generator, a vehicle, or the like. As a result, the amount of air hose required to couple the air compressor to each tool is greatly increased, in many cases becoming unwieldy to store and transport. Further, because workers are remotely located from the air compressor, they often cannot readily access the air compressor's pressure regulator and pressure gauges to control the amount of pressure being provided to their tools.

Consequently, it would be advantageous to provide an air compressor having a removable manifold assembly that can be remotely located from the air compressor and attached thereto via a single air hose for distributing compressed air from the air compressor to multiple air powered tools. Such a manifold assembly should provide means for adjusting the air pressure provided to the air powered tools and for indicating pressures within the compressed air storage tank and manifold outlet pressure remotely.

SUMMARY OF THE INVENTION

Accordingly, the present invention is directed to a manifold assembly for an air compressor that is capable of controlling and distributing compressed air from the air compressor to one or more air powered tools. The manifold assembly may be attached directly to the air compressor, or, alternately, removed from the air compressor and coupled thereto via a conduit such as an air hose or the like, so that the manifold assembly can be used at locations remote from the air compressor. In exemplary embodiments of the invention, the manifold assembly may include a pressure regulator assembly for regulating the pressure of air provided to the air powered tools and indicators for indicating the pressure of compressed air in the air compressor's compressed air storage tank and/or the manifold assembly's outlet pressure.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
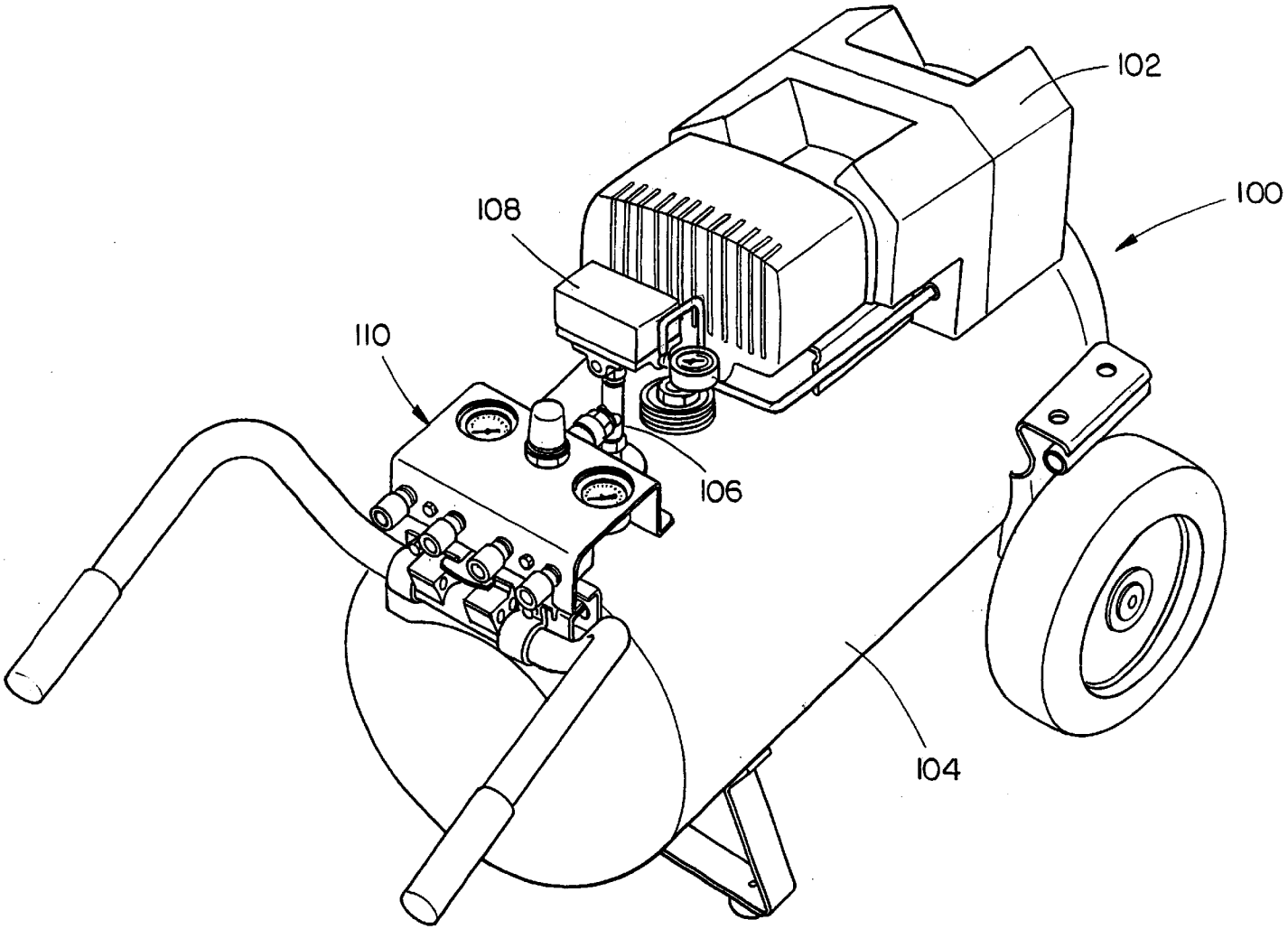
FIG. 1 is an isometric view illustrating an air compressor having a removable manifold assembly suitable for use at locations remote to the air compressor in accordance with an exemplary embodiment of the present invention.
Figure 2:
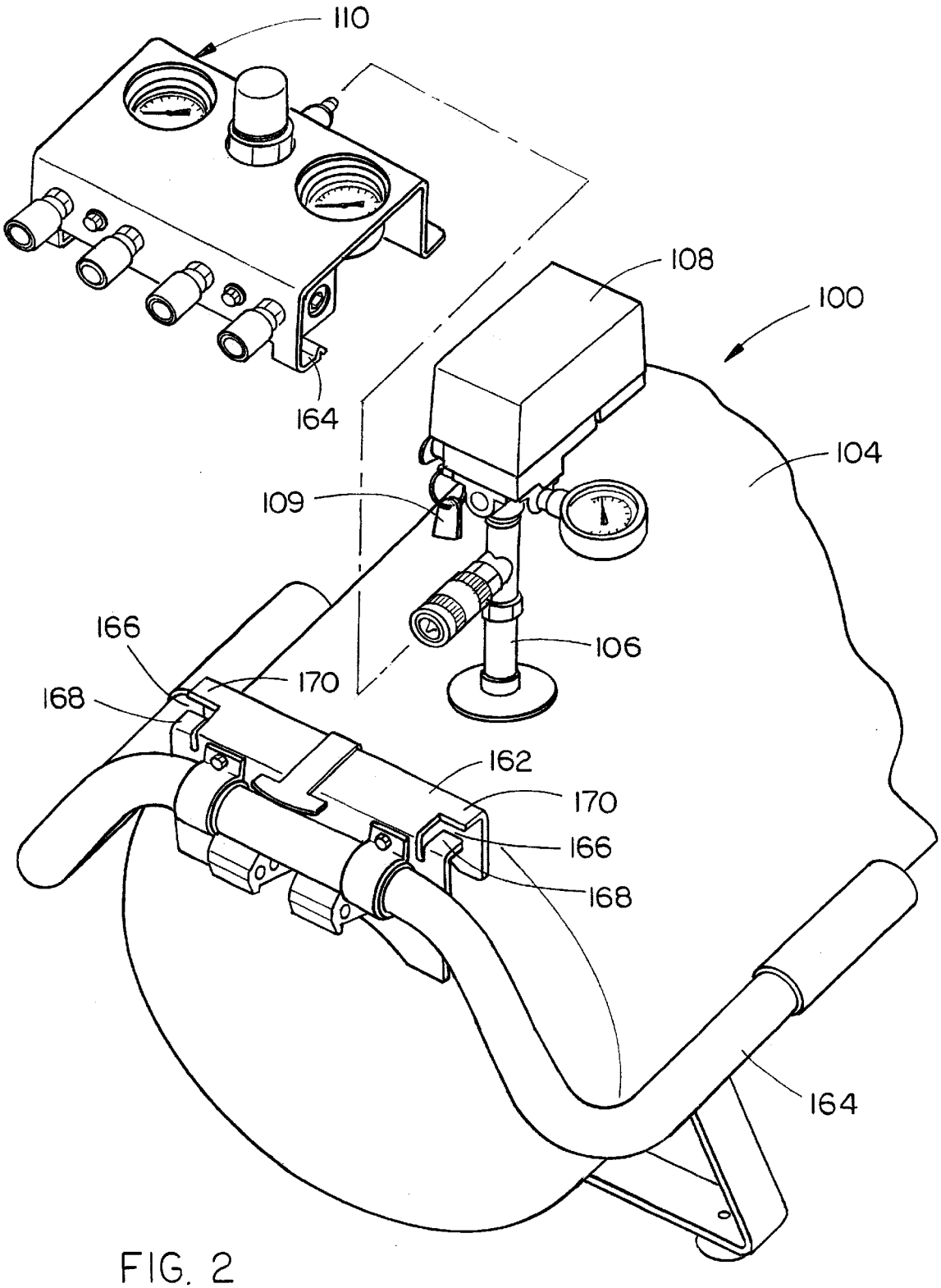
FIG. 2 is exploded isometric view illustrating the air compressor shown in FIG. 1 with the manifold assembly removed.

Referring generally to FIGS. 1 through 4, an air compressor 100 in accordance with an exemplary embodiment of the present invention is described. As shown in FIGS. 1 and 2, the air compressor 100 includes a compressor 102 mounted to a compressed air storage tank 104. The compressed air storage tank 104 provides a reservoir or receiver for storing air under pressure. A port (often referred to as a "spud") is provided in the compressed air storage tank 104 to which a pressure manifold or pipe 106 is fitted allowing compressed air to be drawn from the tank 104 for powering air powered tools such as nailing tools, socket driving tools, material shaping tools, sanding tools, spray painting tools, tire inflation chucks, and the like.

A pressure switch assembly 108 is mounted to the pressure manifold 106 for regulating pressure within the compressed air storage tank 104 by alternately starting and stopping the compressor 102 to periodically replenish the supply of air in the tank 104. When pressure within the tank 104 reaches a preset low pressure point, or "kick-in pressure", the pressure switch assembly 108 starts the compressor 102 to re-pressurize the tank 104. As the pressure within the tank 104 reaches a preset high pressure point, or "kick-out pressure", the pressure switch assembly 108 stops the compressor 102 to prevent over-pressurization of the tank 104. In this manner, the pressure of the compressed air in the compressed air storage tank 104 is maintained within a range generally suitable for powering one or more air powered tools. The pressure manifold 106 may include a safety pressure relief valve for relieving pressure within the pressure manifold 106. In accordance with an exemplary embodiment, the pressure relief valve is opened by a user by pulling outward on an enlarged ring having a tab or "fob" 109 providing a label surface attached thereto. Preferably, the ring and fob 109 are sized to be easily gripped by users of the air compressor 100 to open the safety pressure relief valve.

In accordance with an exemplary embodiment of the present invention, the air compressor 100 is provided with a manifold assembly 110 for controlling and distributing compressed air from the air compressor to one or more air powered tools. The manifold assembly 110 may be attached directly to the air compressor 100, as shown in FIG. 1, or, alternately, removed from the air compressor 100, as shown in FIG. 2, and coupled thereto via a single air hose allowing the manifold assembly to be utilized at locations remote from the air compressor 100 (see FIGS. 11, 12 and 13). The manifold assembly 110 is comprised of a pneumatic manifold 112 and pressure regulator assembly 114 supported in a housing or frame 116. In FIGS. 1 through 4, the pneumatic manifold 112 and frame 116 are shown as separate components attached together by suitable fasteners. However, it should be appreciated that the pneumatic manifold 112 and frame may be of one-piece construction without departing from the scope and spirit of the present invention.

Figure 3:
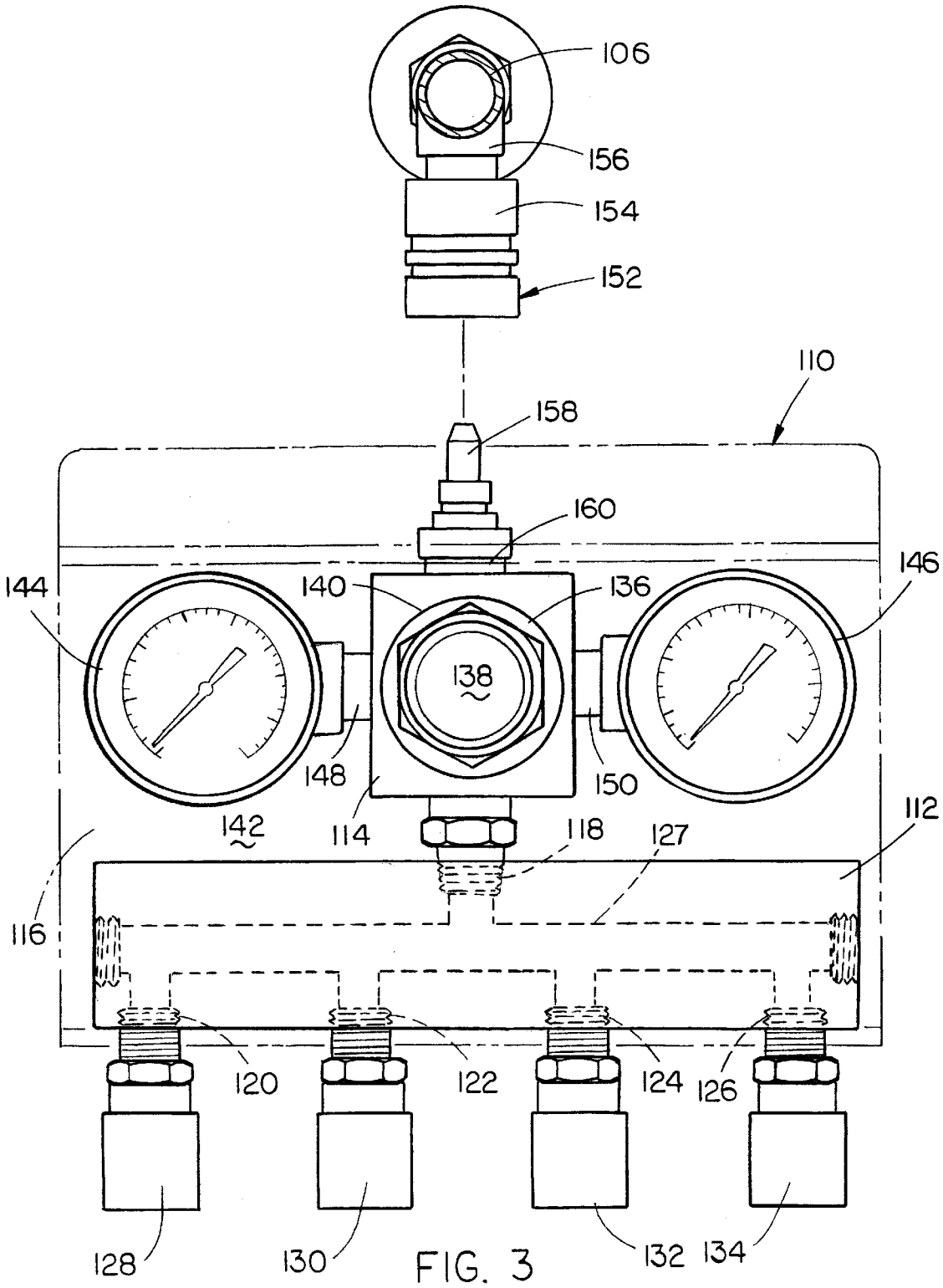
FIG. 3 is a partial cross-sectional top plan view illustrating the manifold assembly of the air compressor shown in FIG. 1.
Figure 4:
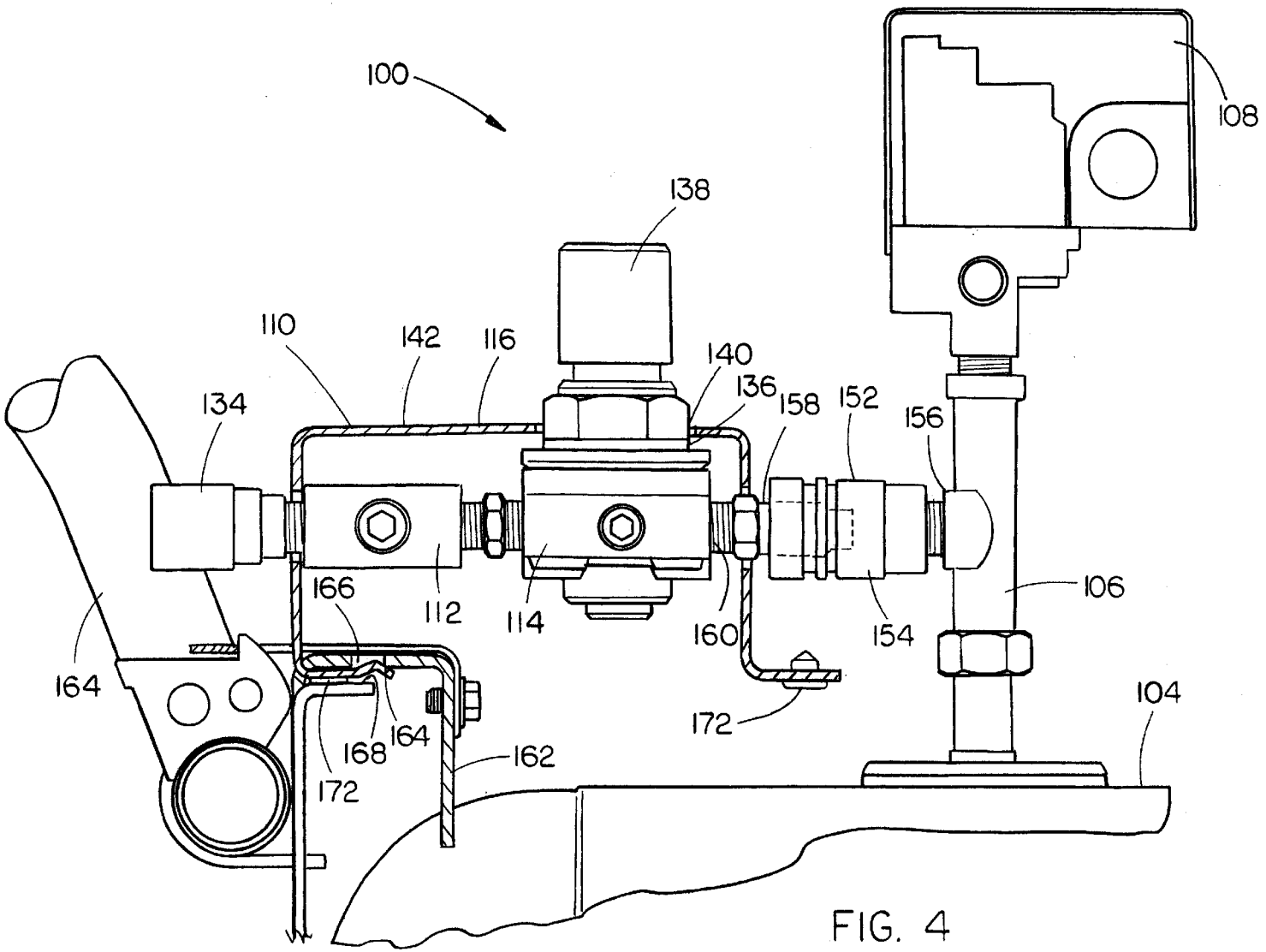
FIG. 4 is a partial side elevational cross-sectional of the air compressor shown in FIG. 1, further illustrating apparatus for securing the manifold assembly to the air compressor's compressed air storage tank.

As shown in FIGS. 3 and 4, the pneumatic manifold 112 includes an inlet port 118 coupled to one or more outlet ports (four outlet ports 120, 122, 124 & 126 are shown) via an internal passage 127. The outlet ports 120, 122, 124 & 126 are fitted with suitable couplers or connectors 128, 130, 132 & 134 which extend through apertures formed in the frame 116 allowing for attachment and removal of air hoses between the manifold assembly 110 and one or more air powered tools (see FIGS. 11, 12 and 13). For instance, in exemplary embodiments of the invention, couplers 128, 130, 132 & 134 may be comprised of quick-connect coupler bodies for allowing attachment and removal of air hoses without the use of tools. Alternately, one or more of the outlet ports 120, 122, 124 & 126 may be fitted with a quick-connect coupler plug or stud allowing attachment of air hoses equipped with a quick-connect coupler bodies, a threaded connector (male or female), or the like as contemplated by one of ordinary skill in the art.

The pressure regulator assembly 114 is coupled to the pneumatic manifold 112 via inlet port 118. In one embodiment, shown in FIG. 3, the pressure regulator assembly 114 includes a single pressure regulator valve 136 that may be opened and closed by a user of the air compressor 100, for example, by turning a knob 138 extending through an aperture 140 formed in the face 142 of frame 116, to regulate the pressure of compressed air within the pneumatic manifold 112 and provided at outlet ports 120, 122, 124 & 126. Alternately, multiple pressure regulator valves may be provided for regulating the pressure provided at each outlet port 120, 122, 124 & 126 independently, or at specific groups of the outlet ports 120, 122, 124 & 126. The pressure regulator assembly 114 may further include indicators for indicating pressures within the air compressor 100 and/or manifold assembly 110. For instance, as shown in FIG. 3, the manifold assembly may include an indicator 144 for indicating the pressure of unregulated compressed air in the compressed air storage tank 104 and pressure manifold 106, and an indicator 146 for indicating the regulated pressure of compressed air in the pneumatic manifold 112. In exemplary embodiments, the indicators 144 & 146 are comprised of high pressure gauges coupled to ports 148 & 150 in the pressure regulator valve 136, and oriented so that the dials of the gauges are viewable through apertures formed in the face 142 of the manifold assembly frame 116.

The manifold assembly 110 is coupled to pressure manifold 106 via a suitable coupling device 152 allowing it to be quickly and easily removed from the air compressor 100. In one embodiment shown in FIGS. 3 and 4, the coupling device 152 is comprised of a quick-connect coupler body 154 fitted to the outlet port 156 of pressure manifold 106. This quick-connect coupler body 154 mates with a corresponding quick-connect coupler plug or stud 158 fitted to the inlet port 160 of the manifold assembly's pressure regulator assembly 114 when the manifold assembly 110 is directly attached to the air compressor 100, as shown in FIG. 1. Preferably, when mated together, the quick-connect coupler plug 158 is retained within the quick-connect coupler body 154 until physically uncoupled by a user of the air compressor 100 to remove the manifold assembly 110. The coupling device 152 thus provides both a pneumatic connection between the manifold assembly 110 and the pressure manifold 106, and a mechanical connection between the manifold assembly 110 and the compressed air storage tank 104 for at least partially securing the manifold assembly 110 to the air compressor 100 and eliminating the need for separate latching or locking mechanisms to perform this function. However, it will be appreciated that supplementary latching or locking mechanisms may be provided to further secure the manifold assembly 110 to the air compressor 100 if desired. Further, when the manifold assembly 110 is removed from the air compressor 100, as shown in FIG. 2, the quick-connect coupler body 154 may be mated to a quick connect coupler plug fitted to a first end of the air hose (not shown) providing a pneumatic connection between the pressure manifold 106 and air hose. Likewise, the quick connect coupler plug 158 may be mated to a quick connect coupler body fitted to a second end of the hose, pneumatically coupling the air hose to the manifold assembly 110 so that air may be provided to the manifold assembly 110.

Turning now to FIGS. 2 and 4, the compressed air storage tank 104 may further be provided with a mounting bracket 162 for supporting the manifold assembly 110 while it is directly attached to the air compressor 100. In an exemplary embodiment, the lower portion of the manifold assembly frame 116 includes one or more tabs 164 spaced so as to be generally aligned with notches or openings 166 formed in mounting bracket 162. When the manifold assembly 110 is attached to the air compressor 100, as shown in FIGS. 1 and 4, these tabs 164 extend through the openings 166 so as to at least partially rest on supports 168 formed in the mounting bracket 162. As the manifold assembly 110 is slid rearward, i.e., toward the pressure manifold 106, so that the quick-connect coupler plug 158 fitted thereto may be mated with the quick-connect coupler body 154 fitted to the pressure manifold 106, the tabs 164 engage the mounting bracket 162 by at least partially sliding under the bracket's upper face 170, attaching the manifold assembly 110 to the compressed air storage tank 104. As shown in FIG. 4, the bottom surface of each tab 164 may include small knob or foot 172 preferably formed of a non-marring, wear resistant material such as plastic, a composite, or the like. When the manifold assembly 110 is attached to the air compressor 100, this foot 172 substantially fills any gap between the tab 164 and the support 168 to prevent excessive play between the manifold assembly 110 and mounting bracket 162.

Figure 5:
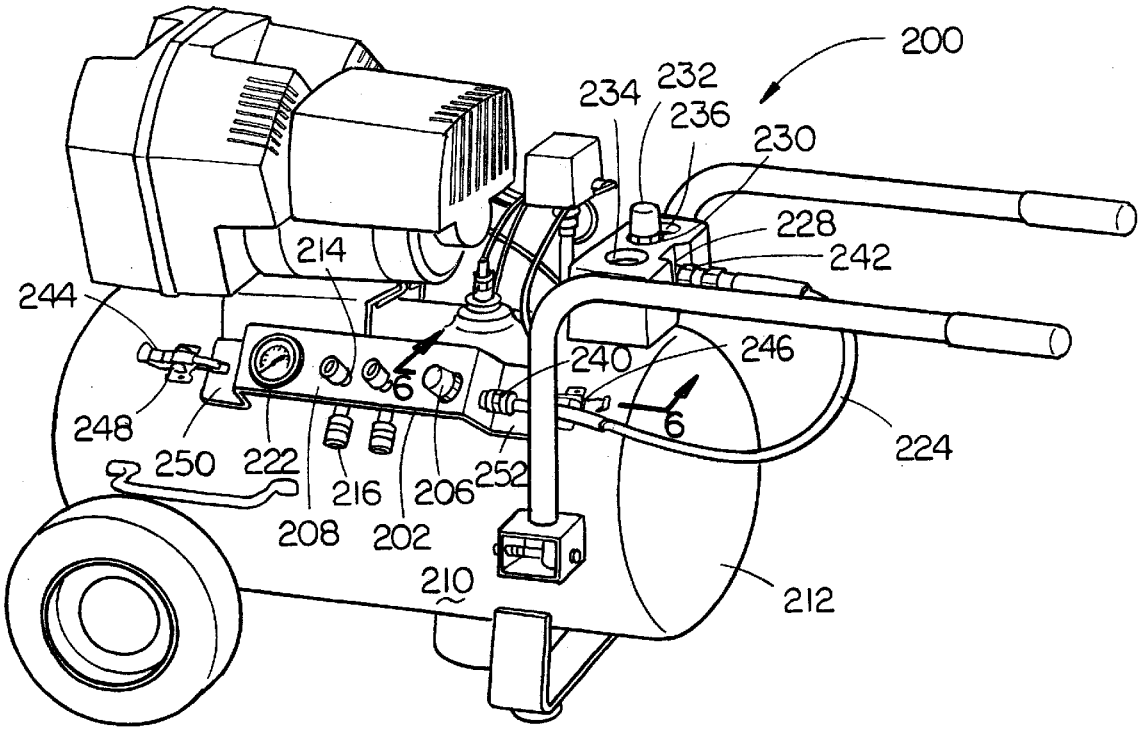
FIG. 5 is an isometric view of an air compressor assembly having a removable manifold assembly suitable for use at locations remote to the air compressor in accordance with an exemplary embodiment of the present invention wherein the manifold assembly is mounted to the side of the air compressor's compressed air storage tank.
Figure 6:
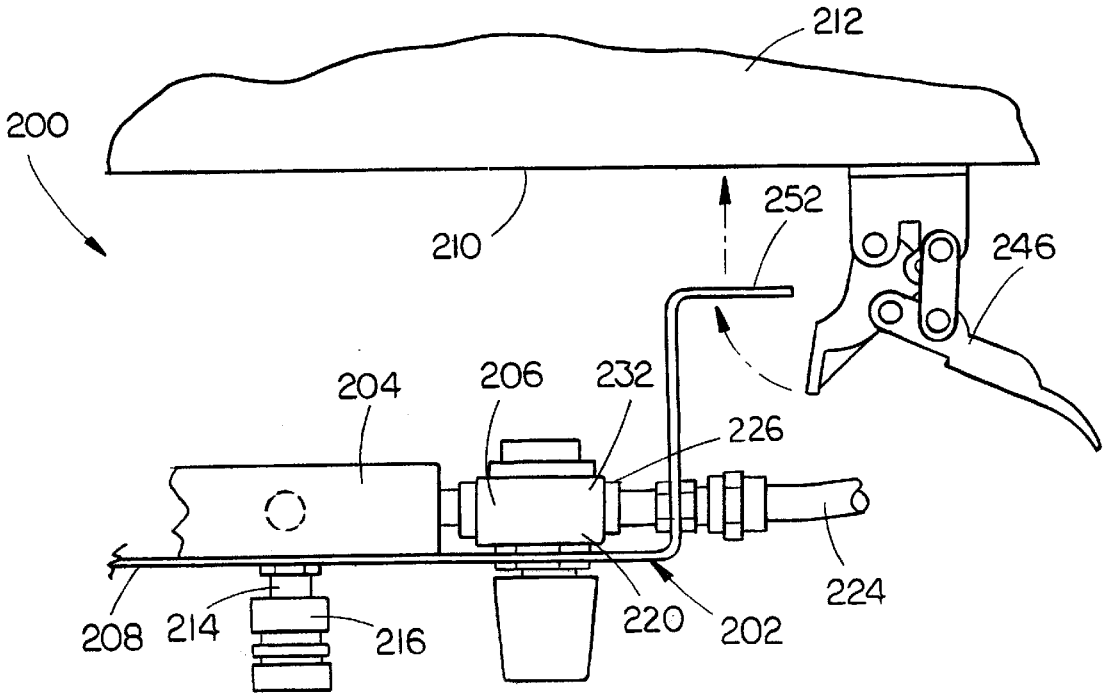
FIG. 6 is a partial cross-sectional side elevational view illustrating manifold assembly of the air compressor shown in FIG. 5.

Referring now to FIGS. 5 and 6, an air compressor 200 having a manifold assembly 202 in accordance with a further exemplary embodiment of the present invention is described. The manifold assembly 202 includes a pneumatic manifold 204 and pressure regulator assembly 206 mounted to a frame 208 capable of being attached to the side wall 210 of the air compressor's compressed air storage tank 212. Outlet ports 214 in the pneumatic manifold 204 are fitted with couplers or connectors 216 for allowing attachment and removal of air hoses (not shown) to provide compressed air to one or more air powered tools (see FIGS. 11, 12 and 13). In exemplary embodiments of the invention, these couplers 216 may be comprised of quick-connect coupler bodies for allowing attachment and removal of air hoses without the use of tools. Alternately, the couplers 216 may comprise quick-connect coupler plugs allowing attachment of air hoses equipped with a quick-connect coupler bodies, a threaded connector (male or female), or the like as contemplated by one of ordinary skill in the art.

The pressure regulator assembly 206 includes one or more pressure regulator valves 220 that may be opened and closed by a user of the air compressor 200 to regulate the pressure of compressed air provided at outlet ports 214. Indicators may be provided for indicating various pressures within the air compressor/air hose/manifold assembly/air powered tool system. For example, as shown in FIG. 5, the manifold assembly 202 includes a single pressure gauge 222 for indicating the regulated pressure of compressed air in the pneumatic manifold 204.

The manifold assembly 202 is pneumatically coupled to the air compressor 200 via a short length of air hose 224 extending between the inlet port 226 of the manifold assembly's pressure regulator valve 220 and the outlet port 228 of a second pressure regulator assembly 230 mounted to the compressed air storage tank 212 and coupled to the compressed air storage tank's pressure manifold. As shown in FIG. 5, the second pressure regulator assembly 230 may include a pressure regulator valve 232 for regulating the pressure of compressed air provided at outlet port 228 and one or more indicators (pressure gauges 234 & 236 are shown) for indicating pressures within the air compressor/manifold assembly system. In this manner, the pressure provided to manifold assembly 202 may be regulated at the air compressor 200 while the manifold assembly 202 is being used remotely. Further, the air compressor 200 may be used independently of manifold assembly 202 if desired.

Quick-connect coupler devices 240 & 242 connect the air hose 224 to inlet port 226 and outlet port 228 allowing the air hose 224 to be easily disconnected from either port. In this manner, a longer length of air hose may be provided between the air compressor 200 and manifold assembly 202 when the manifold assembly 202 is removed from the compressed air storage tank 212, for example, when being used at a remote location. Such a longer length of air hose may, for example, be coupled between the inlet port 226 and air hose 224, between air hose 224 and outlet port 228, or directly between inlet port 226 and outlet port 228, air hose 224 being completely removed.

A latching assembly 244 may be provided for securing the manifold assembly 202 to the air storage tank 212. In an exemplary embodiment, the latching assembly 244 is comprised of clamps 246 & 248 which may be closed on a flanges 250 & 252 formed in the manifold assembly's frame 208 to secure the manifold assembly to the side of the air tank 212. When opened, the clamps 246 & 248 release the flanges 250 & 252 allowing the manifold assembly to be lifted from the side of the air storage tank 212 for use at a remote location. It will now be appreciated that the latching assembly 244 may utilize other latching mechanisms for securing the manifold assembly to compressed air storage tank and substitution of such alternative latching mechanisms for those specifically described herein by those of skill in the art is possible and such substitution would not depart from the scope and spirit of the present invention as set forth in the appended claims.

In FIGS. 1 through 6, manifold assemblies in accordance with the present invention are shown configured for use with an air compressor having a single horizontally disposed, cylindrical compressed air storage tank, typically referred to informally in the art as a "hot-dog" style tank. However, it should be appreciated that air compressors utilizing manifold assemblies in accordance with the present invention may employ a wide variety of compressed air storage tank configurations. For example, instead of the generally horizontal compressed air storage tank shown in FIGS. 1 through 6, an air compressor employing the manifold assembly of the present invention may, for example, comprise a vertically disposed "hot-dog" style tank or a flattened oval tank, often referred to informally in the art as a "pancake" style tank. Similarly, instead of the single large tank shown, an air compressor employing a manifold assembly in accordance with the present invention may utilize two or more smaller air storage tanks. For example, such an air compressor may employ two horizontally disposed cylindrical compressed air storage tanks positioned side by side, a tank configuration often referred to informally in the art as a "double hot-dog" style tank. Use of such tank configurations would not depart from the scope and spirit of the present invention.

Referring now to FIGS. 7 through 10, exemplary portable air compressors 300, 400 are shown wherein the air compressors 300, 400 are equipped with a roll cage 302, 402 to which a manifold assembly is mounted in accordance with an exemplary embodiment of the present invention. Each air compressor 300, 400, respectively includes a roll cage 302,402 which supports the air compressor's compressed air storage tank or tanks 304, 404 and compressor 306, 406. Preferably, the roll cage 302, 402 at least partially encloses the compressed air storage tanks 304, 404, compressor 306, 406, pressure switch assembly 308, 408, and pressure manifold 310, 410 for protecting these components from damage due to contact with foreign objects. The roll cage 302, 402 may further provide grips or handles 312, 412 allowing a user or users to lift the air compressor 300, 400 for transport.

Figure 7:
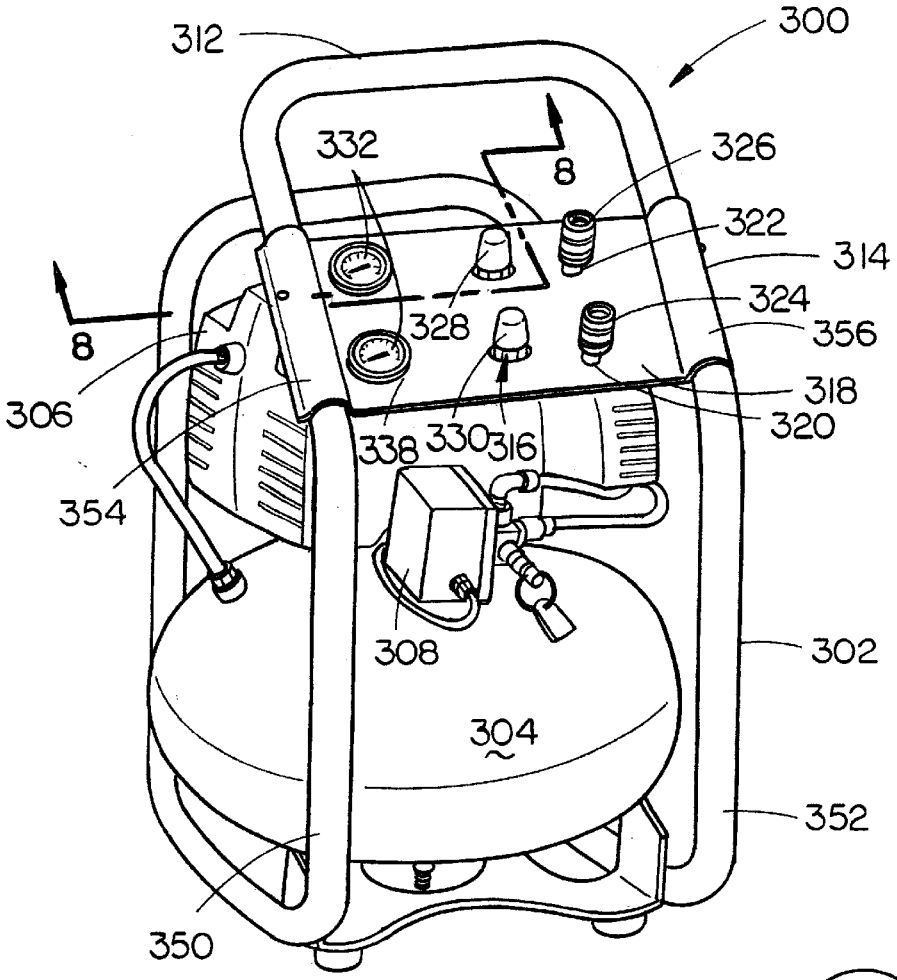
FIG. 7 is an isometric view of a "pancake" type air compressor assembly having a removable manifold assembly suitable for use at locations remote to the air compressor in accordance with an exemplary embodiment of the present invention.

In one embodiment, shown in FIG. 7, the compressed air storage tank 304 of air compressor 300 may be comprised of a flattened oval or "pancake" style tank. In such an embodiment, the roll cage 302 may form a cradle substantially surrounding the tank 304 and compressor 306. In another embodiment, shown in FIG. 9, the air compressor 400 may include two horizontally disposed cylindrical compressed air storage tanks 404 positioned side by side in a vertically oriented "double hot-dog" configuration. In this embodiment, the compressed air storage tanks 404 are mounted to, and form part of the back portion of the roll cage 402, while only the compressor 406, pressure switch assembly 408, and pressure manifold 410 are substantially surrounded by the cage 402.

Figure 9:
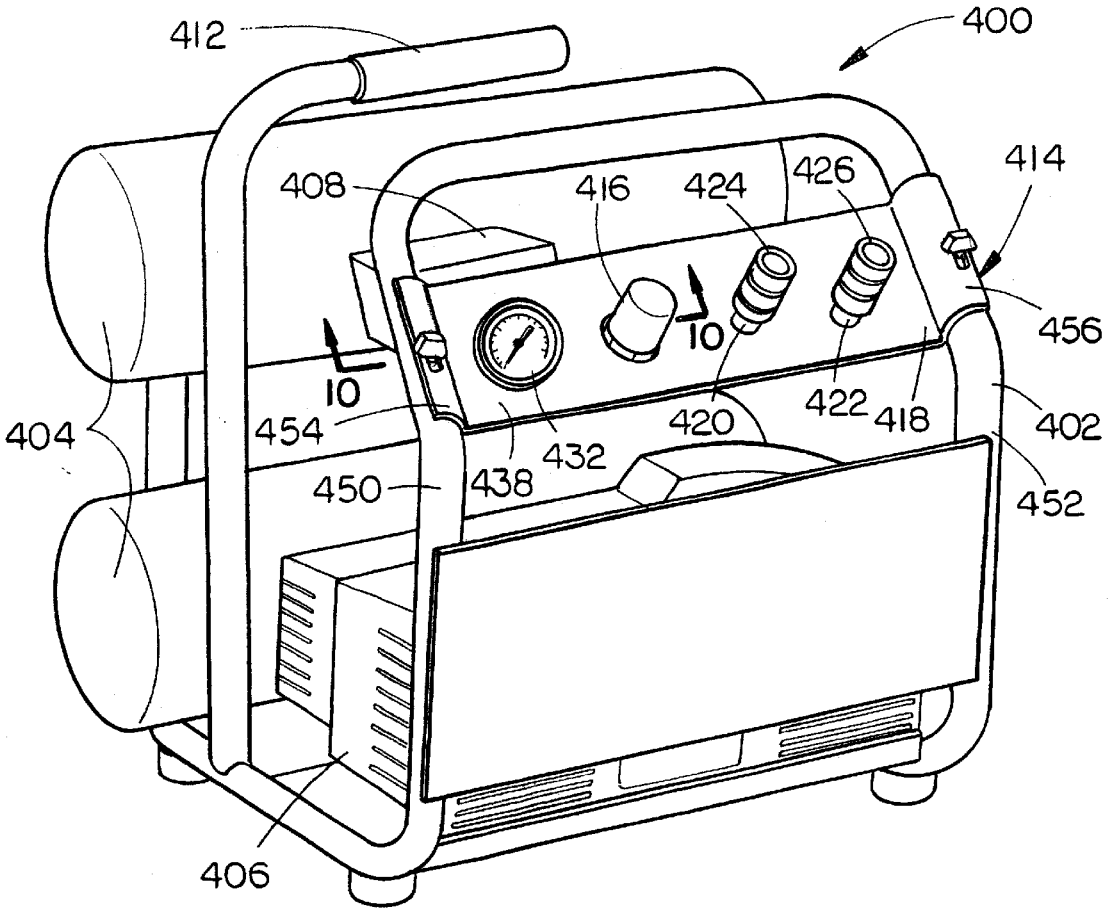
FIG. 9 is an isometric view of a "double hot-dog" type air compressor assembly having a removable manifold assembly suitable for use at locations remote to the air compressor in accordance with an exemplary embodiment of the present invention.
Figure 10:
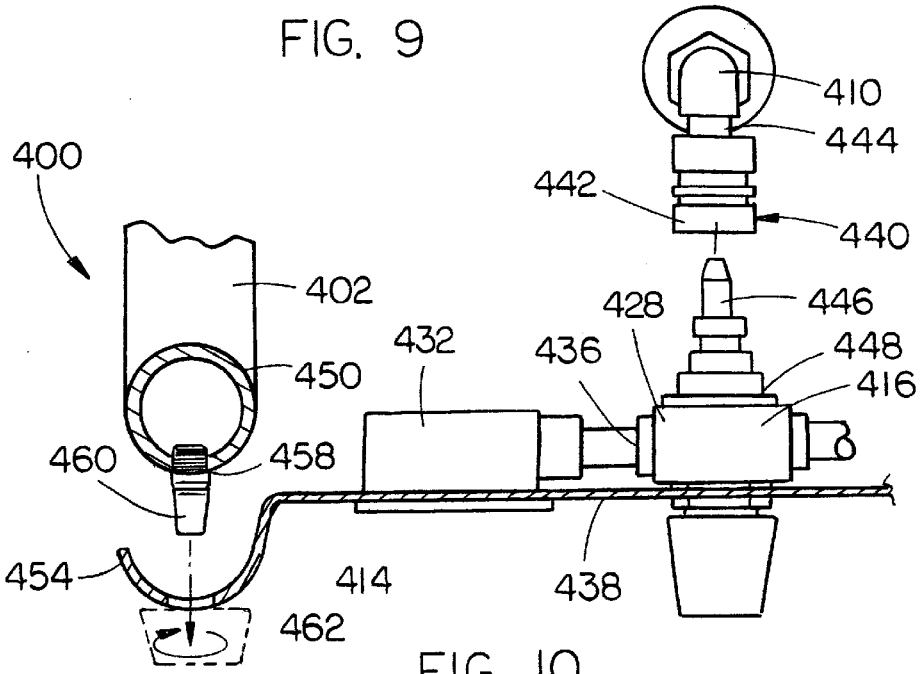
FIG. 10 is a partial cross-sectional side elevational view illustrating manifold assembly of the air compressor shown in FIG. 9.
Figure 11:
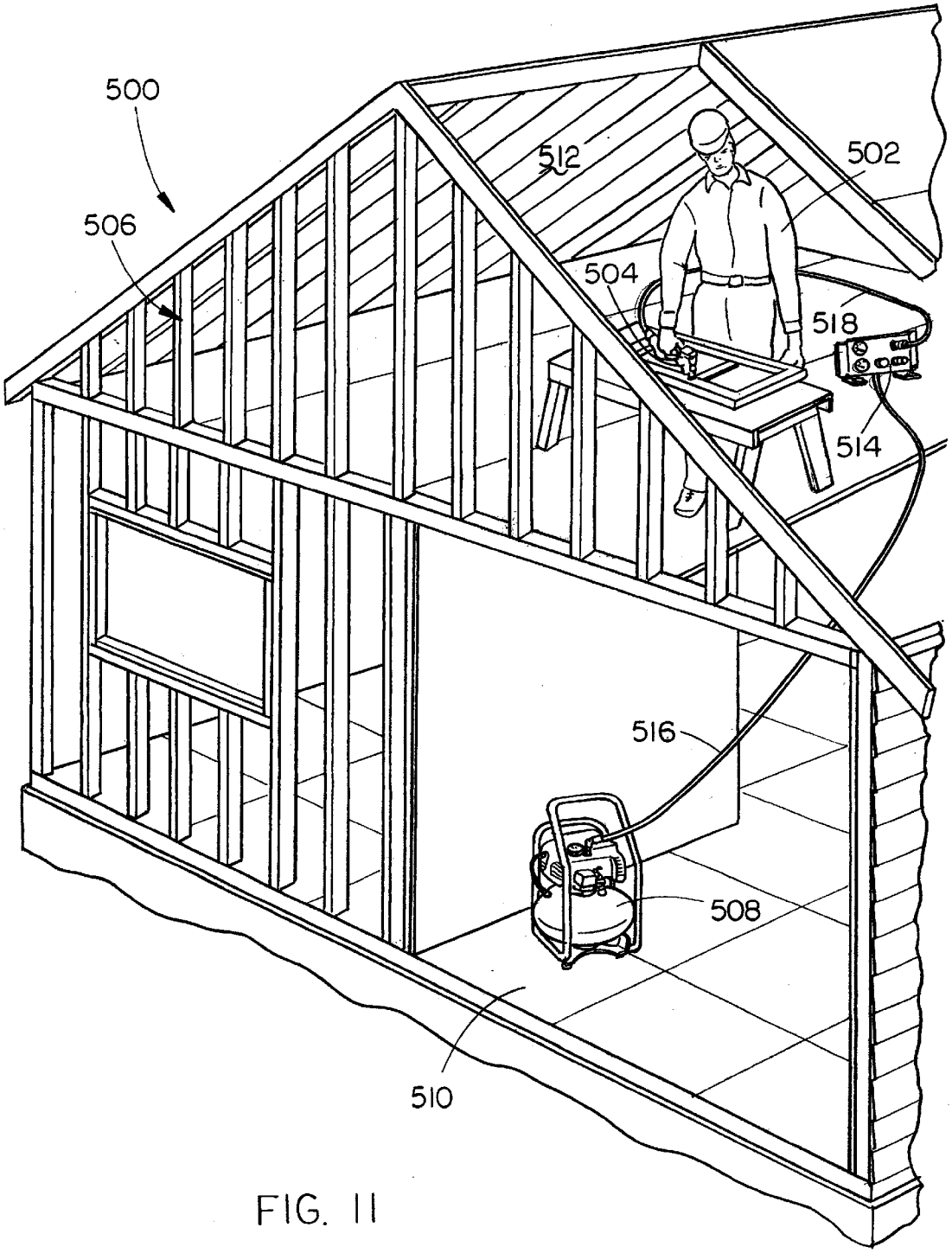
FIG. 11 is an isometric view illustrating an air compressor having a manifold assembly in accordance with an exemplary embodiment of the present invention wherein the manifold assembly is used at a location remote from the air compressor being coupled to the air compressor by a air hose.
Figure 12:
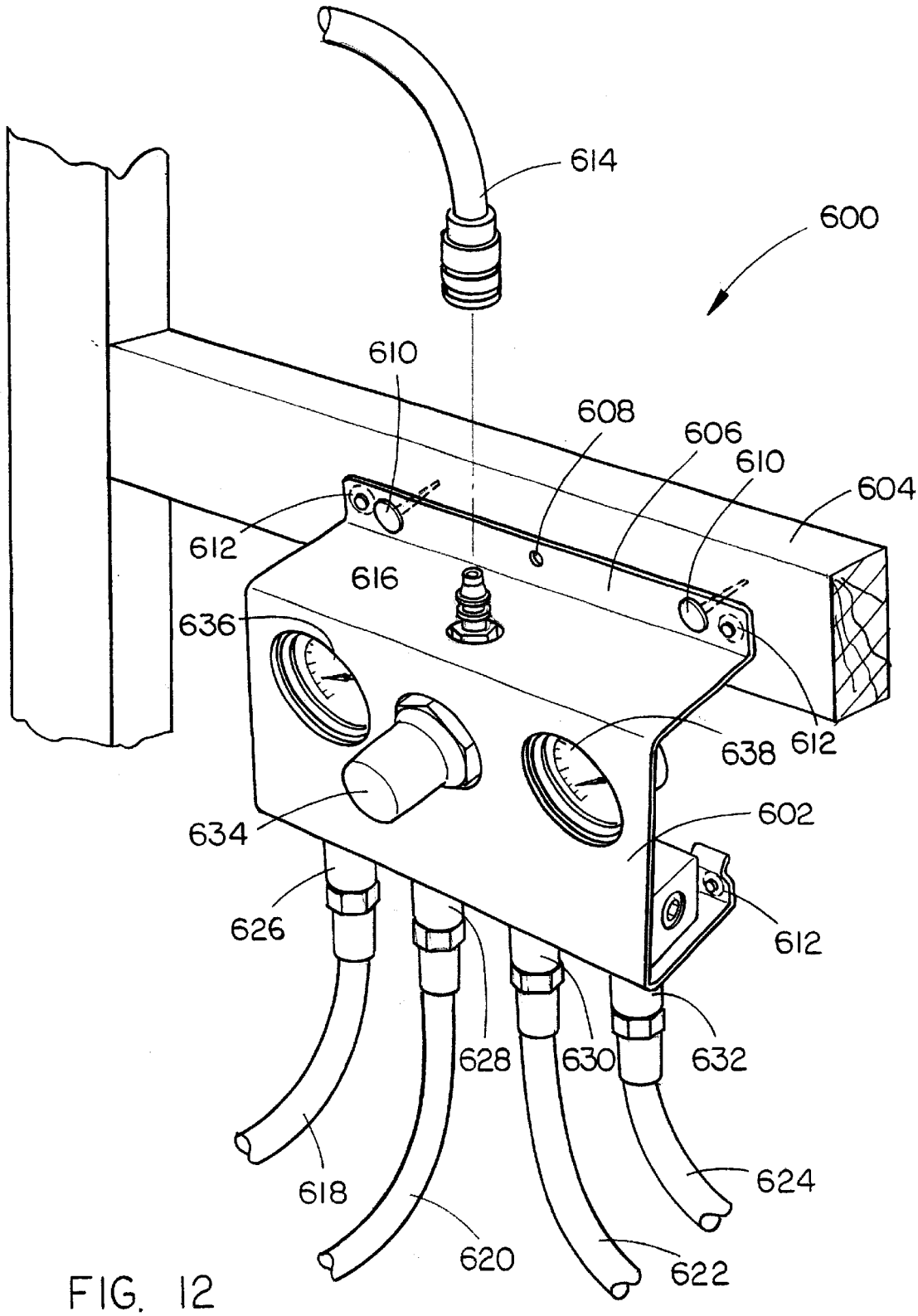
FIG. 12 is an isometric view illustrating a exemplary manifold assembly attached to a supporting structure at a site remote from the air compressor.
Figure 13:
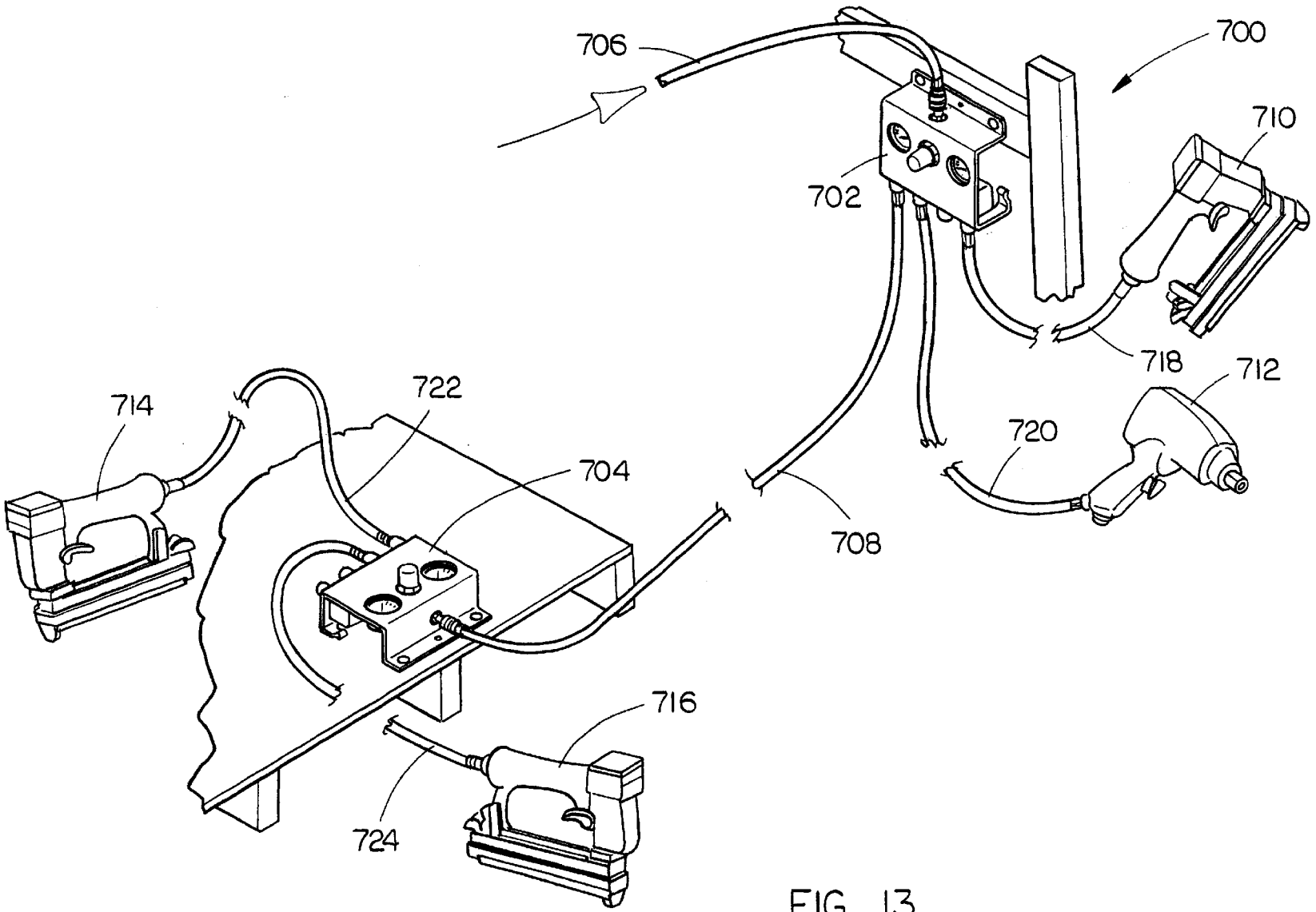
FIG. 13 is an isometric view illustrating a plurality manifold assemblies utilized in tandem at a location remote from the air compressor being coupled to the air compressor by an air hose.

In accordance with an exemplary embodiment of the present invention, the air compressors 300, 400 shown in FIGS. 7 and 9 are provided with a manifold assembly 314, 414 for controlling and distributing compressed air from the air compressor 300, 400 to one or more air powered tools (see FIGS. 11, 12 and 13). The manifold assembly 314, 414 may be attached directly to the air compressor 300, 400, or, alternately, removed from the air compressor 300,400 and coupled thereto via a single air hose so the manifold assembly 314, 414 may be utilized at locations remote from the air compressor 300, 400 (see FIGS. 11, 12 and 13).

As shown in FIGS. 7 and 9, the manifold assemblies 314, 414 include a pneumatic manifold (not shown) and at least one pressure regulator assembly 316, 416 coupled to a supporting frame 318, 418. Outlet ports 320, 322, 420 & 422 within the pneumatic manifold are fitted with suitable couplers or connectors 324, 326, 424 & 426 which extend through apertures in the frame 318, 418 for allowing attachment and removal of air hoses to provide compressed air to one or more air powered tools (see FIGS. 11, 12 and 13). In exemplary embodiments of the invention, couplers 324, 326, 424 & 426 may be comprised of quick-connect coupler bodies for allowing attachment and removal of air hoses without the use of tools. Alternately, one or more of the outlet ports 320, 322, 420 & 422 may be fitted with a quick-connect coupler plug or stud allowing attachment of air hoses equipped with a quick-connect coupler bodies, a threaded connector (male or female), or the like as contemplated by one of ordinary skill in the art.

The pressure regulator assembly 316, 416 includes one or more pressure regulator valves 328, 330,428 that may be opened and closed by a user of the air compressor 300,400 to regulate the pressure of compressed air provided by the pneumatic manifold. In one embodiment, shown in FIG. 7, a separate pressure regulator valve 328 & 330 may be provided for independently regulating the pressure provided at each outlet port 320 & 322 of manifold assembly 314. Alternately, as shown in FIG. 9, a single pressure regulator valve 428 may be provided for regulating the pressure provided at all ports 422, 424. Indicators may be provided for indicating various pressures within the air compressor/air hose/manifold assembly/air powered tool system. For example, indicators 332, 334 & 432 may be provided to indicate the pressure of unregulated compressed air in the compressed air storage tank 304, 404, and/or for indicating the regulated pressure of compressed air in the pneumatic manifold of the manifold assembly 300, 400. In exemplary embodiments, the indicators 332, 334 & 432 are comprised of high pressure gauges coupled to ports 336 & 436 in the pressure regulator valve 328, 428 (FIGS. 8 and 10), and oriented so that the dials of the gauges are viewable through apertures formed in the face 338,438 of the manifold assembly frame 318, 418.

Figure 8:
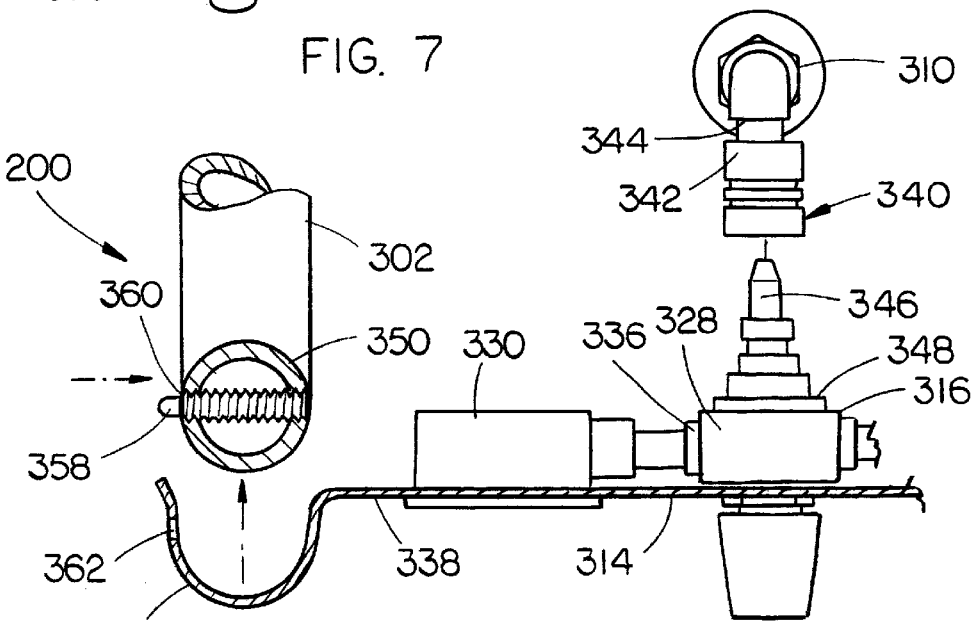
FIG. 8 is a partial cross-sectional side elevational view illustrating manifold assembly of the air compressor shown in FIG. 7.

As shown in FIGS. 6 and 8, the manifold assembly 314, 414 is coupled to the pressure manifold 310,410 via a suitable coupling device 340,440 allowing it to be quickly and easily removed from the air compressor 100. In the exemplary embodiments shown, the coupling device 340, 440 is comprised of a quick-connect coupler body 342, 442 fitted to the outlet port 344, 444 of the pressure manifold 310, 410. This quick-connect coupler body 342, 442 mates with a corresponding quick-connect coupler plug or stud 346, 446 fitted to the inlet port 348, 448 of the manifold assembly's pressure regulator assembly 316, 416 when the manifold assembly 314, 414 is directly attached to the air compressor 300, 400. In this manner, the coupling device 340, 440 provides a pneumatic connection between the manifold assembly 314, 414 and the pressure manifold 310, 410. Further, when the manifold assembly 314, 414 is removed from the air compressor 300, 400, the quick-connect coupler body 342, 442 may be mated to a quick connect coupler plug fitted to a first end of the air hose (not shown) providing a pneumatic connection between the pressure manifold 310, 410 and air hose. Likewise, the quick connect coupler plug 346, 446 may be mated to a quick connect coupler body fitted to a second end of the hose, pneumatically coupling the air hose to the manifold assembly 314, 414 thereby connecting the manifold assembly 314, 414 and air compressor 300, 400 so that air may be provided to the manifold assembly 314, 414.

The manifold assembly 314, 414 may be supported by the air compressor's roll cage 302, 402 so that it may be pneumatically attached to the air compressor 100 via the coupling device 340,440. As shown in FIGS. 7 and 9, the front portion of the roll cage 302, 402 may include distal upright cage members 350, 352, 450, and 452. Edge portions 354, 356, 454 & 456 of the manifold assembly frame 314, 414 may be shaped to fit over these cage members 350, 352, 450 & 452 so that the manifold assembly 314, 414 is suspended there between when mounted to the air compressor 100. For instance, in the exemplary embodiment shown in FIGS. 7 through 10, the roll cage 302, 402 may be formed of steel tubing having a generally circular cross-sectional shape. In such an embodiment, the edge portions 354, 356, 454 & 456 of frame 318, 418 may be comprised of channels having a substantially semi-circular cross-section sized to fit over a corresponding cage member 350, 352, 450, and 452.

A latching assembly 358, 458 may be provided for securing the manifold assembly 314, 414 to the air compressor's roll cage 302, 402. Preferably, the latching assembly 358, 458 allows the user to easily remove the manifold assembly 314,414 from the roll cage 302, 402 for remote use. For example, as shown in FIGS. 7 and 8, an exemplary latching assembly 358 may be comprised of a spring loaded plunger 360 positioned in each cage member 350 & 352 for engaging corresponding apertures 362 formed in edge portions 354 & 356 of frame 318. Similarly, a second exemplary latching assembly 458, shown in FIGS. 9 and 10, may comprise one or more one-quarter turn fasteners 460 mounted to each cage member 450 & 452 and positioned to extend through holes 462 formed in the edge portions 454 & 456 of frame 418. It will now be appreciated that the latching assembly 358,458 may utilize other latching mechanisms for securing the manifold assembly to the roll cage depending on the particular design requirements of the air compressor. Consequently, substitution of alternative latching mechanisms for those specifically described herein by those of skill in the art is anticipated, and such substitution would not depart from the scope and spirit of the present invention as set forth in the appended claims.

Referring now to FIG. 11, use of an air compressor having a manifold assembly in accordance with an exemplary embodiment of the present invention is described. In a typical work site 500, such as a residential home construction site (shown), a worker 502 may utilize an air powered tool 504 (a nailing tool is shown) to perform a task or series of tasks. For example, in the construction of a residential structure 506, a worker 502 may utilize air powered tools 504 for performing tasks such as framing walls within the structure 506, hanging dry wall, installing windows or doors, installing roofing, installing flooring, providing interior finishing of the structure, and the like.

Because of constraints at the work site, it may be necessary that the air compressor 508, providing a source of compressed air for operating the tool 504 be located remotely from the worker 502. For example, when building a multiple level structure 506, the air compressor 508 may be located in a lower level 510 of the structure 506, while the worker 502 must perform a task in an upper level or floor 512 of the structure 506. In such applications, the manifold assembly 514 may be detached from the air compressor 508 and coupled thereto via an air hose 516 allowing the manifold assembly 514 to be taken to the worker's location, e.g., in FIG. 11, the upper level 512 of the structure 506. The worker 502 may then couple the air powered tool 504 to the manifold assembly 514 via a second air hose 518 to provide compressed air for powering the tool 504. As discussed in the description of FIGS. 1 through 10, the manifold assembly may include a pressure regulator assembly and indicators for indicating various pressures within the air compressor 508 and manifold assembly 514 thereby allowing the user to monitor and control the pressure of the air provided to the tool 504 without returning to the air compressor's location, e.g., in FIG. 11, the lower level 510 of the structure 506.

Turning now to FIG. 12, an exemplary manifold assembly is shown secured to a supporting structure at a work site. In a typical work site 600, such as a construction site or the like, the manifold assembly 602 may be secured to a supporting structure 604, such as a 2×4 framing member, a wall, a floor surface, a work table, or the like to provide a convenient means of locating the manifold assembly at the site 600. In an exemplary embodiment, the manifold assembly's frame 606 may include a flange 608 having one or more holes formed therein. Fasteners 610 such as a nails (shown), screws, bolts, or the like may extend or be driven though these holes for attaching the manifold assembly to the supporting structure 604. Alternately, one or more clamps may be provided for clamping the manifold assembly 602 to the supporting structure 604, or, the manifold assembly may be provided with a stand or base suitable for supporting the manifold assembly on a generally horizontal surface such as a table top, a floor, or the ground (see FIG. 11).

Small knobs or feet 612 formed of a non-marring, wear resistant material such as plastic, a composite, or the like on the bottom surface of the frame 606 prevent direct contact with the frame 606 and supporting structure 604 for preventing unnecessary damage to the supporting structure 604 or manifold assembly 602 due to contact or rubbing during use. An air hose 614 is connected to inlet port 616 of the manifold assembly 602 for pneumatically coupling the manifold assembly 602 to an air compressor (not shown). Similarly, one or more air hoses 618, 620, 622 & 624 may be connected to outlet ports 626, 628, 630 & 632 for coupling one or more air powered tools (not shown) to the manifold assembly 602. A pressure regulator assembly 634 and indicators such as pressure gauges 636 & 638 allow users to monitor and control the pressure of air provided at the outlet ports 626, 628, 630 & 632.

Referring now to FIG. 13, in accordance with an exemplary embodiment of the invention multiple manifold assemblies may be chained together to provide compressed air to air powered tools at several locations in a work site. In a typical work site 700, such as a construction site or the like, a first manifold assembly 702 may be pneumatically coupled to an air compressor via an air hose 706. As shown in FIG. 13, the first manifold assembly 702 may be secured to a supporting structure, such as a 2×4 framing member (shown), a wall, a floor surface, a work table, or the like at a first location at the work site 700. A second manifold assembly 704 is coupled to an outlet port of the first manifold assembly 702 via an air hose 708. The second manifold assembly 704 may be secured to a supporting structure, such as a floor surface, a 2×4 framing member, a wall, a work table, or the like at a second location at the work site 700. One or more air powered tools 710, 712, 714 & 716 may by pneumatically coupled to either the first manifold assembly 702 or second manifold assembly 704 via air hoses 718, 720, 722 & 724 for use at either the first location or the second location, respectively. In this manner, compressed air may be supplied to multiple locations within a work site from a single air compressor (not shown) for powering air powered tools at each location. Alternately, multiple manifold assemblies may be located within close proximity to each other so that compressed air may be supplied to a greater number of tools that would be possible with a single manifold assembly.

In FIGS. 1 through 13, the air compressor is illustrated as having a compressor of the type having a reciprocating piston pump driven by an electric motor. However, it should be appreciated that air compressors having manifold assemblies in accordance with the present invention may employ other compressor technologies. For instance, an air compressor might employ a reciprocating piston pump driven by a small internal combustion engine via a belt drive, a rotary or turbine pump driven by an electric motor or internal combustion engine, and the like. Use of such alternate compressor technologies would not depart from the scope and spirit of the present invention.

It will be appreciated that manifold assemblies in accordance with the present invention may at times be removed from the air compressor and used within the immediate vicinity of the air compressor. Consequently, the terms "remote", "remotely located" and "remote location" utilized herein should not be limited by the distance separating the manifold assembly and air compressor. Instead, such terms should be construed as encompassing any use of the manifold assembly while detached from the air compressor regardless of the distance of separation between the manifold assembly and air compressor.

It is believed that the manifold assembly of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. An air compressor assembly, comprising:

an air compressor suitable for providing a source of compressed air; and a manifold assembly removably mountable to said air compressor, said manifold assembly comprising a frame suitable for mounting said manifold assembly to a supporting structure and a pneumatic manifold supported in said frame suitable for distributing compressed air from said air compressor to at least one air powered tool;

wherein said air compressor and said manifold assembly are capable of being coupled together via an air conduit when said manifold assembly is removed from said air compressor so that said manifold assembly is operable at a location remote from said air compressor.

2. The air compressor assembly as claimed in claim 1, further comprising a coupling device for pneumatically coupling said manifold assembly to said air compressor, said coupling device at least partially securing said manifold assembly to said air compressor.

3. The air compressor assembly as claimed in claim 1, wherein said coupling device comprises a quick-connect coupler.

4. The air compressor assembly as claimed in claim 1, wherein said frame comprises a flange having at least one hole formed therein through which a fastener may extend.

5. The air compressor assembly as claimed in claim 1, wherein said frame comprises at least one non-marring foot for preventing contact between said manifold assembly and said supporting structure.

6. The air compressor assembly as claimed in claim 1, wherein said air compressor includes a mounting bracket suitable for being engaged by said frame to at least partially secure said manifold assembly to said air compressor.

7. The air compressor assembly as claimed in claim 1, wherein said manifold assembly further comprises a pressure regulator assembly suitable for regulating the pressure of said distributed air.

8. The air compressor assembly as claimed in claim 1, wherein said manifold assembly further comprises at least one indicator for indicating the pressure of compressed air provided to said at least one air powered tool.

9. The air compressor assembly as claimed in claim 1, wherein said manifold assembly comprises at least one indicator for indicating the pressure of air in said air tank.

10. The air compressor assembly as claimed in claim 1, wherein said manifold assembly comprises a plurality of output connectors, each of said output connectors capable of being coupled to an air conduit for supplying compressed air to at least one air powered tool.

11. The air compressor assembly as claimed in claim 1, wherein said air compressor further comprises:

an air storage tank suitable for containing a supply of compressed air, said air storage tank including a pressure manifold having an outlet port;

a compressor suitable for supplying compressed air to said air storage tank; and a pressure manifold for pneumatically coupling said manifold assembly to said air storage tank.

12. An air compressor assembly, comprising:

an air compressor suitable for providing a source of compressed air;

a manifold assembly removably mountable to said air compressor, said manifold assembly comprising a frame and a pneumatic manifold supported in said frame suitable for distributing compressed air from said air compressor to at least one air powered tool; and a mounting bracket coupled to said air compressor, said mounting bracket suitable for being engaged by said frame to at least partially secure said manifold assembly to said air compressor;

wherein said air compressor and said manifold assembly are capable of being coupled together via an air conduit when said manifold assembly is removed from said air compressor so that said manifold assembly is operable at a location remote from said air compressor.

13. The air compressor assembly as claimed in claim 12, wherein said frame is suitable for mounting said manifold assembly to a supporting structure.

14. The air compressor assembly as claimed in claim 12, further comprising a coupling device for pneumatically coupling said manifold assembly to said air compressor, said coupling device at least partially securing said manifold assembly to said air compressor.

15. The air compressor assembly as claimed in claim 12, wherein said coupling device comprises a quick-connect coupler.

16. The air compressor assembly as claimed in claim 12, wherein said frame comprises a flange having at least one hole formed therein through which a fastener may extend.

17. The air compressor assembly as claimed in claim 12, wherein said frame comprises at least one non-marring foot for preventing contact between said manifold assembly and said supporting structure.

18. The air compressor assembly as claimed in claim 12, wherein said manifold assembly further comprises a pressure regulator assembly suitable for regulating the pressure of said distributed air.

19. The air compressor assembly as claimed in claim 12, wherein said manifold assembly further comprises at least one indicator for indicating the pressure of compressed air provided to said at least one air powered tool.

20. The air compressor assembly as claimed in claim 12, wherein said manifold assembly comprises at least one indicator for indicating the pressure of air in said air tank.

21. The air compressor assembly as claimed in claim 12, wherein said manifold assembly comprises a plurality of output connectors, each of said output connectors capable of being coupled to an air conduit for supplying compressed air to at least one air powered tool.

22. The air compressor assembly as claimed in claim 12, wherein said air compressor further comprises:

an air storage tank suitable for containing a supply of compressed air, said air storage tank including a pressure manifold having an outlet port;

a compressor suitable for supplying compressed air to said air storage tank; and a pressure manifold for pneumatically coupling said manifold assembly to said air storage tank.

23. A manifold assembly for an air compressor, comprising a frame suitable for mounting said manifold assembly to a supporting structure; and a manifold coupled to said frame, said manifold being suitable for distributing compressed air from said air compressor to at least one air powered tool;

wherein said manifold assembly is capable of being coupled to said air compressor via an air conduit so that said manifold assembly is operable at a location remote from said air compressor.

24. The manifold assembly as claimed in claim 23, further comprising a coupling device suitable for pneumatically coupling said manifold assembly to said air compressor, said coupling device at least partially securing said manifold assembly to said air compressor.

25. The manifold assembly as claimed in claim 24, wherein said coupling device comprises at least one of a quick-connect coupler stud and a quick connect coupler body.

26. The manifold assembly as claimed in claim 23, wherein said frame comprises a flange having at least one hole formed therein through which a fastener may extend.

27. The manifold assembly as claimed in claim 23, wherein said frame comprises at least one non-marring foot for preventing contact between said manifold assembly and said supporting structure.

28. The manifold assembly as claimed in claim 23, further comprising a pressure regulator assembly suitable for regulating the pressure of said distributed air.

29. A The manifold assembly as claimed in claim 23, further comprising at least one indicator for indicating the pressure of compressed air provided to said at least one air powered tool.

30. The manifold assembly as claimed in claim 23, further comprising at least one indicator for indicating the pressure of air in said air tank.

31. The manifold assembly as claimed in claim 23, further comprising a plurality of output connectors, each of said output connectors capable of being coupled to an air conduit for supplying compressed air to at least one air powered tool.

32. An air compressor assembly, comprising:

an air compressor for providing a source of compressed air;

a manifold assembly removably mountable to the air compressor, the manifold assembly comprising a frame and a pneumatic manifold supported in the frame for distributing compressed air from the air compressor to at least one air powered tool; and a mounting bracket coupled to the air compressor for engaging the frame to mount the manifold assembly to the air compressor and disengaging the frame to allow the manifold assembly to be removed from the air compressor assembly, wherein the air compressor and the manifold assembly are capable of being coupled together via an air conduit when the manifold assembly is removed from the air compressor so that the manifold assembly is operable at a location remote from the air compressor.

33. The air compressor assembly as claimed in claim 32, further comprising a pneumatic coupling device for pneumatically coupling the manifold assembly to the air compressor when mounting bracket is engaged with the frame.

34. The air compressor assembly as claimed in claim 32, wherein the pneumatic coupling device cooperates with the mounting bracket and frame for securing the manifold assembly to the air compressor.

35. The air compressor assembly as claimed in claim 34, wherein the coupling device comprises a quick-connect coupler.

36. The air compressor assembly as claimed in claim 32, wherein the frame comprises a flange having at least one hole formed therein through which a fastener may extend for fastening the flange to a to a supporting structure when the manifold assembly is removed from the air compressor.

37. The air compressor assembly as claimed in claim 36, wherein the frame comprises at least one non-marring foot for preventing contact between the manifold assembly and the supporting structure.

38. The air compressor assembly as claimed in claim 32, wherein the manifold assembly further comprises a pressure regulator assembly for regulating the pressure of the distributed air, at least one indicator for indicating the pressure of compressed air provided to the at least one air powered tool, and a plurality of output connectors, each of the output connectors capable of being coupled to an air conduit for supplying compressed air to an air powered tool.

39. The air compressor assembly as claimed in claim 38, wherein the air compressor further comprises:

an air storage tank for containing a supply of compressed air, the air storage tank including a pressure manifold having an outlet port;

a compressor for supplying compressed air to the air storage tank; and a pressure manifold for pneumatically coupling the manifold assembly to the air storage tank.

40. The air compressor assembly as claimed in claim 39, wherein the manifold assembly further comprises an indicator for indicating the pressure of air in the air storage tank.

41. An air compressor assembly, comprising:

an air compressor for providing a source of compressed air; and a manifold assembly removably mountable to the air compressor, the manifold assembly comprising a frame for mounting the manifold assembly to a supporting structure, the frame including at least one non-marring foot for preventing contact between the manifold assembly and the supporting structure, and a pneumatic manifold supported in the frame for distributing compressed air from the air compressor to at least one air powered tool, wherein the air compressor and the manifold assembly are capable of being coupled together via an air conduit when the manifold assembly is removed from the air compressor so that the manifold assembly is operable at a location remote from the air compressor.

42. The air compressor assembly as claimed in claim 41, further comprising a coupling device for pneumatically coupling the manifold assembly to the air compressor, the coupling device at least partially securing the manifold assembly to the air compressor.

43. The air compressor assembly as claimed in claim 41, wherein the coupling device comprises a quick-connect coupler.

44. The air compressor assembly as claimed in claim 41, wherein the frame comprises a flange having at least one hole formed therein through which a fastener may extend.

45. The air compressor assembly as claimed in claim 41, wherein the air compressor includes a mounting bracket, the frame engaging the mounting bracket to at least partially secure the manifold assembly to the air compressor.

46. The air compressor assembly as claimed in claim 41, wherein the manifold assembly further comprises a pressure regulator assembly for regulating the pressure of the distributed air.

47. The air compressor assembly as claimed in claim 41, wherein the manifold assembly further comprises at least one indicator for indicating the pressure of compressed air provided to the at least one air powered tool.

48. The air compressor assembly as claimed in claim 41, wherein the manifold assembly comprises at least one indicator for indicating the pressure of air in the air tank.

49. The air compressor assembly as claimed in claim 41, wherein the manifold assembly comprises a plurality of output connectors, each of the output connectors capable of being coupled to an air conduit for supplying compressed air to at least one air powered tool.

50. The air compressor assembly as claimed in claim 41, wherein the air compressor further comprises:

an air storage tank for containing a supply of compressed air, the air storage tank including a pressure manifold having an outlet port;

a compressor for supplying compressed air to the air storage tank; and a pressure manifold for pneumatically coupling the manifold assembly to the air storage tank.

51. A manifold assembly for an air compressor, comprising a frame for mounting the manifold assembly to a supporting structure, the frame including at least one non-marring foot for preventing contact between the manifold assembly and the supporting structure; and a manifold coupled to the frame for distributing compressed air from the air compressor to at least one air powered tool, wherein the manifold assembly is capable of being coupled to the air compressor via an air conduit so that the manifold assembly is operable at a location remote from the air compressor.

52. The manifold assembly as claimed in claim 51, further comprising a pneumatic coupling device for pneumatically coupling the manifold assembly to the air compressor, the coupling device at least partially securing the manifold assembly to the air compressor.

53. The manifold assembly as claimed in claim 52, wherein the coupling device comprises at least one of a quick-connect coupler stud and a quick connect coupler body.

54. The manifold assembly as claimed in claim 51, wherein the frame comprises a flange having at least one hole formed therein through which a fastener may extend for coupling the manifold assembly to the supporting surface.

55. The manifold assembly as claimed in claim 51, further comprising a pressure regulator assembly for regulating the pressure of the distributed air.

56. The manifold assembly as claimed in claim 51, further comprising at least one indicator for indicating the pressure of compressed air provided to the at least one air powered tool.

57. The manifold assembly as claimed in claim 51, further comprising at least one indicator for indicating the pressure of air in the air tank.

58. The manifold assembly as claimed in claim 51, further comprising a plurality of output connectors, each of the output connectors for being coupled to an air conduit for supplying compressed air to at least one air powered tool.

* * * * *